US006357961B1

(12) United States Patent
Marphetia

(10) Patent No.: US 6,357,961 B1
(45) Date of Patent: Mar. 19, 2002

(54) RETAINER ASSEMBLY FOR USE WITH TIRE DEFLATION DEVICES

(76) Inventor: Toranj Marphetia, 20860 Heatherview Dr., Brookfield, WI (US) 53045-4528

( * ) Notice: Subject to any disclaimer, the term of this patent is extended or adjusted under 35 U.S.C. 154(b) by 0 days.

(21) Appl. No.: 09/562,975

(22) Filed: May 3, 2000

(51) Int. Cl.[7] ..... E01F 13/00
(52) U.S. Cl. ..... 404/6
(58) Field of Search ..... 404/6, 7, 8, 9

(56) References Cited

U.S. PATENT DOCUMENTS 5,253,950 A * 10/1993 Kilgrow et al. ..... 404/6
5,482,397 A * 1/1996 Soleau ..... 404/6
5,536,109 A * 7/1996 Lowndes ..... 404/6
5,775,832 A * 7/1998 Kilgrow et al. ..... 404/6
5,890,832 A * 4/1999 Soleau ..... 404/6
6,048,128 A * 4/2000 Jones, III et al. ..... 404/6
6,155,745 A * 12/2000 Groen et al. ..... 404/6
6,224,291 B1 * 5/2001 Mateycuk ..... 404/6

* cited by examiner

*Primary Examiner*—Thomas B. Will
*Assistant Examiner*—Raymond W. Addie
(74) *Attorney, Agent, or Firm*—Joseph S. Heino

(57) ABSTRACT

A spike retaining base has a top base surface, a generally vertical aperture defined within it, and a plurality of aperture slots. A base insert includes a central hub and a plurality of insert arms. Each arm is foldable so as to allow the insert base to wrap around the base of a tire puncturing spike. When used, the base insert is positioned above the base aperture and the base of a spike is positioned above the base insert. The spike base and the base insert are urged into the base aperture to the point that the spike and the base insert are lockingly engaged with the base. As a tire engages the spike, a bubble at the hub of the base insert allows the base insert to be forced down into the base aperture thereby releasing the spike from the base.

11 Claims, 2 Drawing Sheets

FIG. 4
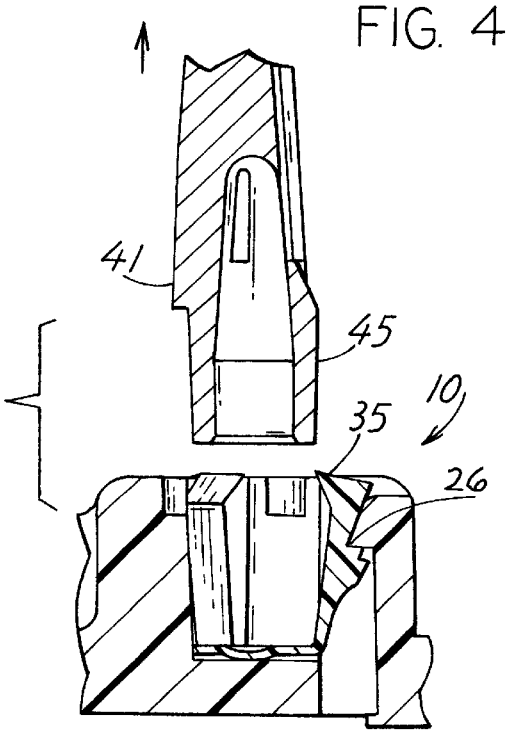
FIG. 5
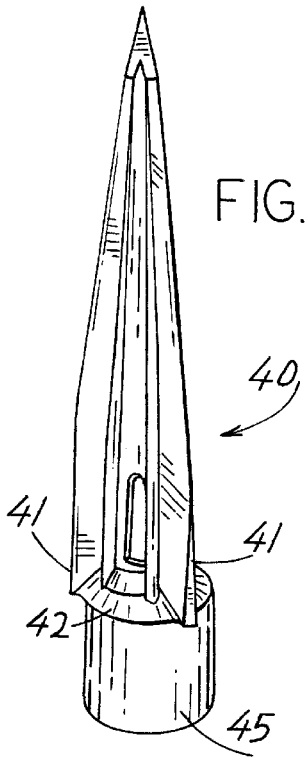
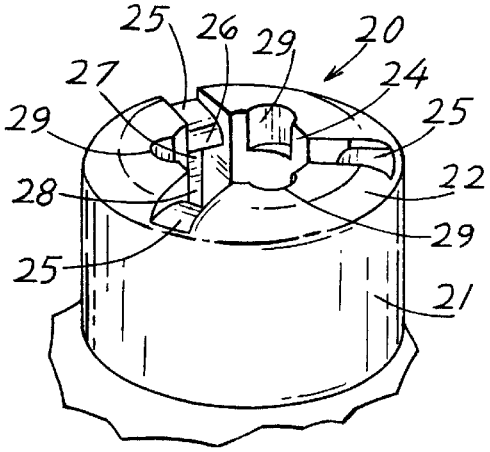
FIG. 6
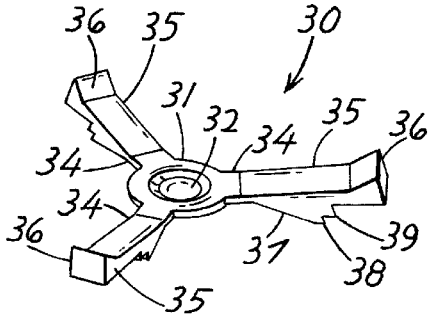
FIG. 7

RETAINER ASSEMBLY FOR USE WITH TIRE DEFLATION DEVICES

FIELD OF THE INVENTION

This invention relates generally to devices used by law enforcement agencies and the like for puncturing the rubber tires of a motor vehicle, thereby slowing down and eventually stopping such motor vehicle. More particularly, this invention relates to an improved retainer assembly for releasably holding a tire puncturing device within the retainer assembly. It also relates to an array having a plurality of such retainer assemblies for utilizing a plurality of deflating spikes within them.

BACKGROUND OF THE INVENTION

The improved retention assembly of the present invention relates to the tire puncturing and deflating spike as disclosed by this inventor in the copending U.S. patent application Ser. No. 09/548,333 entitled "Vehicle Tire Puncturing and Deflating Spike and Assembly Therefor." As disclosed in that application, it is occasionally necessary for law enforcement agencies to impede and altogether stop the movement of a run-away motor vehicle. Direct pursuit of such vehicles is often necessary, but brings with it concerns for public safety when such pursuits lead through city streets and other populated areas. Because such pursuits can also result in high speed chases, the safety of the pursuers is also a concern.

As a safer alternative to the direct pursuit of such vehicles, it has been recognized that strategic placement of tire deflating mechanisms in the path, or the anticipated path, of such run-away motor vehicles can effectively impede and stop the movement of them. Such portable tire deflating mechanisms can be deployed with relative ease and have taken several forms in recent years. One such mechanism is a multiple blade system whereby a plurality of blades, which blades are biased in the direction of the oncoming motor vehicle, are deployed. Other systems utilize what amount to large hollow needles or syringes.

The tire puncturing and deflating spike construction preferred by this inventor is a harder than steel metal alloy spike having a plurality of sharp, fluted edges which are functionally adapted to puncture a rubber tire as the tire passes over the spike. The preferred spike includes a plurality of grooves which extend along the body of the spike to allow pressurized air escaping from the tire to run along the spike grooves and through a plurality of air flow vents. Each air flow vent is an access opening to the interior of the spike which allows the pressurized air to continue to flow through the spike and out of the tire until the tire is completely deflated.

In the experience of this inventor, a safety concern arises when a plurality of such spikes are utilized in a typical spike array. That safety concern is the fact that, as the spike array is run over by the fleeing vehicle, spikes which do not come into direct tire contact may nevertheless become dislodged and be thrown from the array, the retainer has been designed to prevent spikes not picked up by the tires from being thrown.

SUMMARY OF THE INVENTION

It is, therefore, a principal object of this invention to provide a new, useful and uncomplicated retainer assembly for holding tire puncturing and deflating spikes securely within the assembly. It is a further object of this invention to provide such a retainer assembly for releasing such spikes only upon direct tire contact with the spike. It is yet another further object of this invention to provide such a retainer which requires only a minimal number of elements in order to secure a spike within the retainer, which is easy to use and which allows for ready replacement of a withdrawn spike.

The present invention has obtained these objects. It provides a generally cylindrical spike retaining base member having a top base surface. The top base surface has a central and generally vertical aperture defined within it. Appurtenant to the base aperture are a plurality of aperture slots. A base insert is provided which includes a central hub portion and a plurality of insert arms. The number of arms of the insert corresponds to the number of aperture slots defined within the base. Each arm is foldable at its proximal end relative to the insert hub so as to allow the insert base to wrap around the base of a tire puncturing spike. The distal end of each arm includes a spike retention lip. The central portion of each arm includes a first shoulder and a second shoulder. The first and second shoulders of each arm is engageable with a ridge defined within the aperture slot of the base member. As used, the base insert is positioned above the base member aperture and the base of a spike is positioned above the base insert. The base insert arms are aligned such that each will slidingly engage the appurtenant aperture slots of the base member. The spike base and the base insert are urged into the base member aperture to the point that the first shoulder of each insert arm engages the ridge of the base slot. At this point, the spike and the base insert are lockingly engaged with the base member and will remain so until the spike is driven over by an inflated tire. As a tire engages the spike and forces it downwardly, a bubble at the hub of the base insert will allow the base insert to be forced further down into the base aperture. The insert arms will be urged downwardly to the point that the second shoulder of each arm is engaged with the ridge of each aperture slot thereby allowing the arms of the insert to be spread apart and releasing the spike from the base member. The foregoing and other features of the device of the present invention will be further apparent from the detailed description which follows.

BRIEF DESCRIPTION OF THE DRAWINGS

FIG. 4 is another partial view of that shown in FIGS. 1 and 3 and showing the spike being withdrawn from the retaining device.

FIG. 5 is a perspective plan view of a puncturing and deflating spike used with the device of the present invention.

FIG. 6 is a perspective view of the base member of the device of the present invention.

FIG. 7 is a perspective view of the insert member of the device of the present invention.

DETAILED DESCRIPTION

Figure 1:
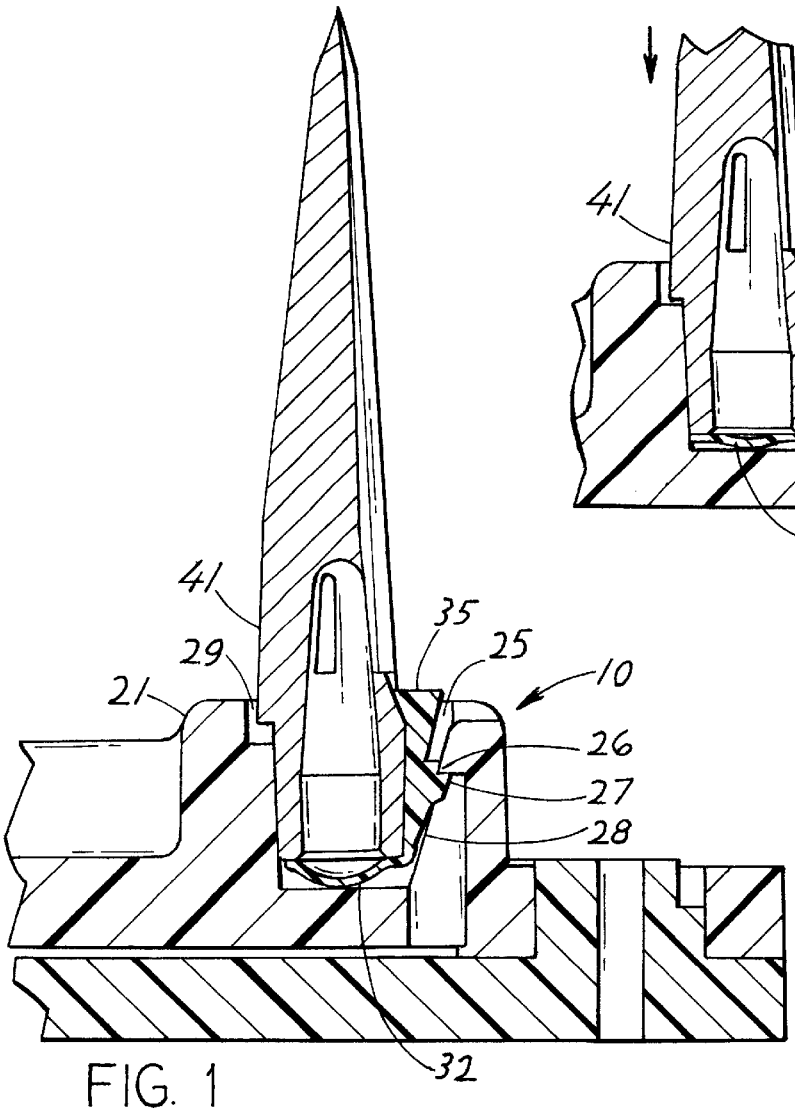
FIG. 1 is a cross sectioned elevational side view of a device constructed in accordance with the present invention and showing the device in its normal spike retaining position.

Referring now to the drawings in detail, FIG. 1 shows a preferred embodiment of the tire puncturing and deflating spike retaining assembly, generally identified 10, which is constructed in accordance with the present invention. As shown in FIGS. 6 and 7, the spike retaining assembly 10 includes a base member, generally identified 20, and a base insert, generally identified 30. The base member 20 comprises a base cylinder 21, a top surface 22 and a centrally located and cylindrically-shaped aperture 24 defined within the base cylinder 21. In the preferred embodiment, the base cylinder 21 is constructed of a plastic material. Extending outwardly from and appurtenant to the base aperture 24 is a plurality of aperture slots 25. Each slot 25 is identically configured for reasons which will become apparent later in this detailed description. In the preferred embodiment, three aperture slots 25 are provided. Each aperture slot 25 includes, beginning towards the top surface 22 of the base member 21 and moving downwardly along the slot 25, a slot ridge 26, a slot recess 27 and a slot shoulder 28. Again, the purpose and function of each of these elements will be apparent further in this detailed description. Finally, the top surface 22 of the base member 21 also includes a plurality of secondary recesses 29 each of which is situated between the base slots 25. The secondary recesses 29 are functionally adapted to receive the lowermost portion of a spike blade 41 when a spike, generally identified 40, is inserted into the base member 21. A representative spike 40 of the type used with the assembly 10 of the present invention is shown in FIG. 5.

Referring now to FIG. 7, a base insert 30 is shown in its pre-assembly condition. As shown, the insert 30 includes a centrally located hub 31 at the center of which is located a downwardly extending pressure bubble 32. In the preferred embodiment, the insert 30, like the base member 20, is constructed of a plastic material. The pressure bubble 32 is configured to provide some resiliency to the insert hub 31. Extending outwardly from the hub 31 of the insert 30 is a plurality of insert arms 35. Because the number of insert arms 35 corresponds to the same number of slots 25 defined within the base member 21, the insert 30 of the preferred embodiment has three arms 35. Each arm 35 is resiliently bendable upwardly at its proximal end at an arm joint 34. With all of the insert arms 30 bent upwardly, the insert assumes the resemblance of a cup-like receptacle. Indeed, the insert 30 is functionally adapted to receive the lowermost base portion 45 of a spike 40 between these insert arms 35. On that side of the insert arm 35 which faces the spike base and at the distal end of the insert arm is a spike retaining lip 36. The spike retaining lip 36 corresponds to a shoulder portion 42 at the topmost portion of the base 45 of the spike 40. See FIG. 5. On the opposite side of each insert arm 35, and moving from the proximal portion of each arm 35 relative to the hub 31, is a slide portion 37, a first ridge 38 and a second ridge 39. In the preferred embodiment, the first ridge 37 and the second ridge 39 of each insert arm 35 is each functionally adapted to be received by the slot recess 27 of the base aperture slot 25.

In application, a base insert 30 is positioned, with the bubble 32 facing downwardly, above the aperture 24 of the base member 21. The insert 30 is positioned in such a way that each arm 35 of the insert 30 is aligned with an aperture slot 25 of the base member 21. The cylindrical base portion 45 of a spike 40 is located above the hub 31 of the insert 30 and the spike 40 is urged downwardly forcing it and the insert 30 downwardly into the base aperture 24. As the insert 30 is so urged, the arms 35 of the insert 30 begin to fold over onto the spike base 45 at the joint 34 formed between the hub 31 and each arm 35. As the spike 40 continues on its downward journey, the outwardly facing slides 37 of each arm 35 move over the slot ridges 26 of each slot 25 and then down towards the slot shoulder 28. As this happens, the first ridge 38 of the insert arm 35 engages and locks onto the slot ridge 26. See FIG. 1. At this point, the inwardly facing retention lips 36 of the insert arms 35 securely engage the shoulder 42 of the spike base 45 and the spike 40 is firmly held in a generally upright position. The resiliency of the bubble 32 at the hub 31 of the insert 30 applies some upwardly directed force to insure that the spike 40 remains firmly held in that position. The spike 40 is fully engaged for use and the assembly 10 is ready to be placed into action.

Figure 2:
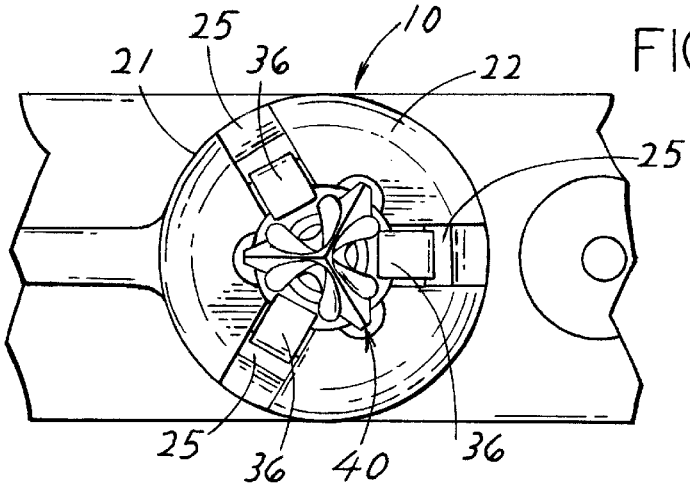
FIG. 2 is a top plan view of the spike retaining device shown in FIG. 1.
Figure 3:
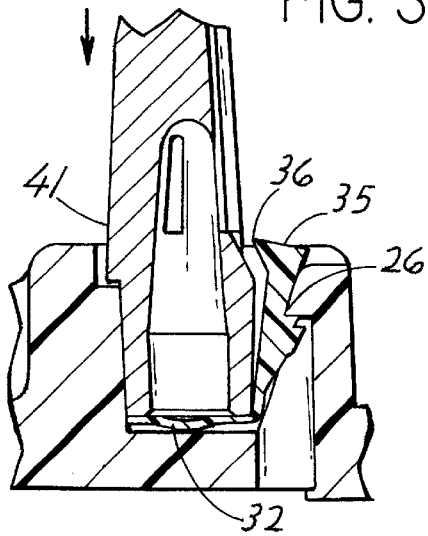
FIG. 3 is a partial view of that shown in FIG. 1 but showing the device in its spike releasing position as contact is made between an inflated tire and the spike.

As the assembly 10 is placed in the path of an oncoming vehicle and a tire of the vehicle engages the upwardly extending spike 40, the vehicle tire places force on the spike 40 which translates down onto the hub bubble 32 of the insert 30. The resiliency of the bubble 32 allows the insert to collapse upon itself sufficiently to allow the slide 37 of each arm to move downwardly over the slot shoulder 28. It also allows the first ridge 38 of each arm 35 to disengage the slot ridge 26 and to re-engage the second ridge 39 with the slot ridge 26 and the slot recess 27. See FIG. 3.

At this point, the insert arms 35 move outwardly and away from the spike base 45 sufficiently to allow the retention lip 36 of each arm to move away from and effectively disengage the shoulder 42 of the spike base 45. At this point, the spike 40 is freed from any retention means and can be easily withdrawn from the base member 21 to continue on its way fully imbedded in the tire of the subject vehicle. See FIG. 4. The spent spike 40 may be easily replaced by using the same base member 21 and a new insert 30 and using the same steps as outlined above.

From the foregoing detailed description of the illustrative embodiment of the invention set forth herein, it will be apparent that there has been provided a new, useful and uncomplicated retainer assembly for holding tire puncturing and deflating spikes securely within the assembly and which releases such spikes only upon direct tire contact with the spike; which requires only a minimal number of elements in order to secure a spike within the retainer; which is easy to use; and which allows for ready replacement of a withdrawn spike.

The principles of this invention having been fully explained in connection with the foregoing, I hereby claim as my invention:

1. For use with an assembly for puncturing and deflating one or more tires of a moving vehicle, said assembly including a plurality of spikes each of which has a spike base, a spike support base and a plurality of spike receiving apertures defined within said spike support base, a spike retainer assembly comprising a plurality of aperture slots defined within each of said spike receiving apertures, each slot having a ridge defined there within, and an aperture insert that is insertable within and receivable by said spike receiving aperture when the base of a spike is inserted therein, said aperture insert including a central hub and a plurality of insert arms extending outwardly therefrom, said insert arms including at least two shoulders, the shoulders of said insert arms cooperating with the ridges of said support aperture whereby the spike base is releaseably locked within the spike support base.

2. The retainer assembly of claim 1 wherein said insert hub includes a bubble for resiliently urging said spike base upwardly within said support aperture.

3. The retainer assembly of claim 2 wherein said spike support base and said support insert are made of a plastic material.

4. A spike retainer assembly for holding a plurality of tire spikes, each tire spike having a spike base, comprising a support base, said support base having an upwardly facing top surface and at least one spike receiving aperture defined within said top surface, said spike receiving aperture including a plurality of appurtenant aperture slots, each slot having a ridge defined therewithin, a support base insert, said support base insert including a central hub and a plurality of insert arms extending outwardly therefrom, said insert arms including at least two shoulders, the shoulders of said insert arms cooperating with the ridges of said support aperture whereby the spike base is releasably locked within the support base, and means for releasing said spike base from said spike receiving aperture when a vehicle tire engages said spike.

5. The retainer of claim 4 wherein said insert hub includes a bubble for resiliently urging said spike base upwardly within said support aperture.

6. The retainer of claim 5 wherein said spike support base and said support insert are made of a plastic material.

7. For use with an assembly designed to retain a plurality of tire puncturing and tire deflating spikes there within, each spike having a cylindrical base portion and a spike shoulder portion, a spike retainer assembly comprising a base member having at least one cylindrically shaped aperture defined within said base member, each aperture having an aperture side wall, a plurality of aperture slots defined within said aperture side wall and extending radially outwardly from the base member aperture, a slot recess defined within each of said aperture slots, a slot shoulder defined within each of said aperture slots, a base insert including a centrally located hub having a downwardly extending pressure bubble formed within said hub and further including a plurality of radially extending and resiliently bendable insert arms, each arm having a spike retaining lip for engaging the shoulders of a spike and a pair of outwardly extending ridges, wherein each arm of the base insert is radially aligned with an aperture slot of the base member and the cylindrical base portion of a spike is insertable into the cylindrical base aperture with the base insert interposed therebetween to the point that the arms of the base insert spring outwardly and the outwardly extending ridges of each base insert arm engages the slot shoulder defined within an aperture slot.

8. The spike retainer assembly of claim 7 wherein each of said plurality of arms on the base insert has a first ridge and a second ridge that fit snugly under the slot ridge and into the slot recess.

9. The spike retainer assembly of claim 8 wherein a plurality of secondary recesses are provided within the base member to accommodate the lowermost portions of the plurality of spike blades on the spike.

10. The spike retainer assembly of claim 9 wherein the outwardly extending ridges of each base insert arm are configured such that one ridge is disposed radially more inwardly of the other ridge such that when a tire of a moving vehicle contacts the tire spike and the tire spike punctures the tire, the tire spike compresses the hub bubble, the arms of the base insert are moved radially outwardly and the spike retaining lip is moved away from the shoulder of the tire spike whereby the tire spike is pulled away from the insert and remains embedded in the punctured tire.

11. The spike retainer assembly of claim 10 wherein the base insert and base member are constructed of plastic.

* * * * *